US011262691B2

(12) United States Patent
Sato et al.

(10) Patent No.: US 11,262,691 B2
(45) **Date of Patent: *Mar. 1, 2022**

(54) IMAGE FORMING APPARATUS

(71) Applicant: BROTHER KOGYO KABUSHIKI KAISHA, Nagoya (JP)

(72) Inventors: Shougo Sato, Seto (JP); Tomoya Ichikawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/857,248

(22) Filed: Apr. 24, 2020

(65) Prior Publication Data

US 2020/0319588 A1 Oct. 8, 2020

Related U.S. Application Data

(63) Continuation of application No. 16/512,553, filed on Jul. 16, 2019, now Pat. No. 10,663,916.

(30) Foreign Application Priority Data

Sep. 18, 2018 (JP) ..... JP2018-174158

(51) Int. Cl.
*G03G 21/18* (2006.01)
*G03G 21/16* (2006.01)
(Continued)

(52) U.S. Cl.
CPC ..... *G03G 21/1842* (2013.01); *G03G 21/10* (2013.01); *G03G 21/105* (2013.01);
(Continued)

(58) Field of Classification Search
CPC ..... G03G 21/1842; G03G 21/1619; G03G 21/1633; G03G 21/1676; G03G 21/1839;
(Continued)

(56) References Cited

U.S. PATENT DOCUMENTS 9,304,484 B2 * 4/2016 Ogino ..... G03G 21/1666
9,342,035 B2 5/2016 Sato
(Continued)

FOREIGN PATENT DOCUMENTS

JP 2016081034 A 5/2016

*Primary Examiner* — Ryan D Walsh
(74) *Attorney, Agent, or Firm* — Merchant & Gould P.C.

(57) ABSTRACT

A first cartridge support is configured to support a drum cartridge. The first cartridge support is configured to move in a first direction between a first position at which the drum cartridge is mounted on a housing and a second position at which the drum cartridge is detachable. A second cartridge support is configured to support a development cartridge. The second cartridge support is configured to move in the first direction between a third position at which the development cartridge is mounted on the drum cartridge and a fourth position at which the development cartridge is detachable. In a state where the second cartridge support is located at the third position, the second cartridge support is located between the first cartridge support located at the first position and a cover located at a closed position with respect to the first direction.

10 Claims, 12 Drawing Sheets

(51) Int. Cl.
*G03G 21/10* (2006.01)
*G03G 21/12* (2006.01)

(52) U.S. Cl.
CPC ..... *G03G 21/12* (2013.01); *G03G 21/1619* (2013.01); *G03G 21/1633* (2013.01); *G03G 21/1676* (2013.01); *G03G 21/1839* (2013.01); *G03G 2221/1624* (2013.01); *G03G 2221/1678* (2013.01); *G03G 2221/1684* (2013.01); *G03G 2221/183* (2013.01); *G03G 2221/1869* (2013.01)

(58) Field of Classification Search
CPC ... G03G 2221/1678; G03G 2221/1684; G03G 2221/183; G03G 2221/1869; G03G 21/10; G03G 21/12; G03G 21/105; G03G 2221/1624

See application file for complete search history.

(56) References Cited

U.S. PATENT DOCUMENTS

| | | | | |
|---|---|---|---|---|
| 10,216,118 | B2 | 2/2019 | Minoshima et al. | |
| 10,663,916 | B2 * | 5/2020 | Sato | G03G 21/1676 |
| 10,663,917 | B2 * | 5/2020 | Ichikawa | G03G 21/1842 |
| 2004/0190932 | A1 | 9/2004 | Ishii | |
| 2006/0228131 | A1 | 10/2006 | Kimura et al. | |
| 2009/0285593 | A1 | 11/2009 | Sakuma | |
| 2009/0324283 | A1 | 12/2009 | Mushika et al. | |
| 2010/0247142 | A1 | 9/2010 | Kikuchi et al. | |
| 2011/0026968 | A1 | 2/2011 | Ishii et al. | |
| 2011/0293317 | A1 | 12/2011 | Nakano et al. | |
| 2012/0183325 | A1 | 7/2012 | Sato et al. | |
| 2012/0294646 | A1 | 11/2012 | Suzuki et al. | |
| 2013/0004200 | A1 | 1/2013 | Okabe | |
| 2015/0346679 | A1 | 12/2015 | Kusano et al. | |
| 2016/0103418 | A1 | 4/2016 | Yada et al. | |
| 2017/0160697 | A1 | 6/2017 | Sato et al. | |
| 2017/0285567 | A1 * | 10/2017 | Fukaya | G03G 21/1821 |
| 2019/0361383 | A1 | 11/2019 | Sato | |
| 2019/0384217 | A1 | 12/2019 | Sato | |
| 2019/0384219 | A1 | 12/2019 | Sato | |

* cited by examiner

IMAGE FORMING APPARATUS

CROSS REFERENCE TO RELATED APPLICATIONS

This application is a continuation of U.S. patent application Ser. No. 16/512,553, filed Jul. 16, 2019, now U.S. Pat. No. 10,663,916; which claims priority from Japanese Patent Application No. 2018-174158 filed Sep. 18, 2018. The entire content of the aforementioned applications are incorporated herein by reference.

TECHNICAL FIELD

This disclosure relates to an image forming apparatus.

BACKGROUND

Conventionally, a cartridge and an image forming apparatus including a drawer supporting a cartridge are known. The cartridge includes a photosensitive drum and a development unit having a development roller. The drawer is movable between a mount position at which the cartridge is mounted on the image forming apparatus and a detachment position at which the cartridge can be detached.

SUMMARY

According to one aspect, this specification discloses an image forming apparatus. The image forming apparatus includes a housing, a cover, a drum cartridge, a development cartridge, a first cartridge support, and a second cartridge support. The housing is formed with an opening. The cover is configured to move between a closed position at which the opening is closed and an open position at which the opening is opened. The drum cartridge includes a photosensitive drum. The development cartridge includes a development roller. The first cartridge support is configured to support the drum cartridge. The first cartridge support is configured to move in a first direction between a first position at which the drum cartridge is mounted on the housing and a second position at which the drum cartridge is detachable. The second cartridge support is configured to support the development cartridge. The second cartridge support is configured to move in the first direction between a third position at which the development cartridge is mounted on the drum cartridge and a fourth position at which the development cartridge is detachable. In a state where the second cartridge support is located at the third position, the second cartridge support is located between the first cartridge support located at the first position and the cover located at the closed position with respect to the first direction.

BRIEF DESCRIPTION OF THE DRAWINGS

Embodiments in accordance with this disclosure will be described in detail with reference to the following figures wherein.

DETAILED DESCRIPTION

In the above-described image forming apparatus, there is a need to replace the development unit separately from the photosensitive drum.

In view of the foregoing, an example of an object of this disclosure is to provide an image forming apparatus in which a development cartridge can be replaced separately from a drum cartridge.

1. Outline of Image Forming Apparatus 1

An outline of an image forming apparatus 1 will be described while referring to FIGS. 1 and 2.

Figure 1:
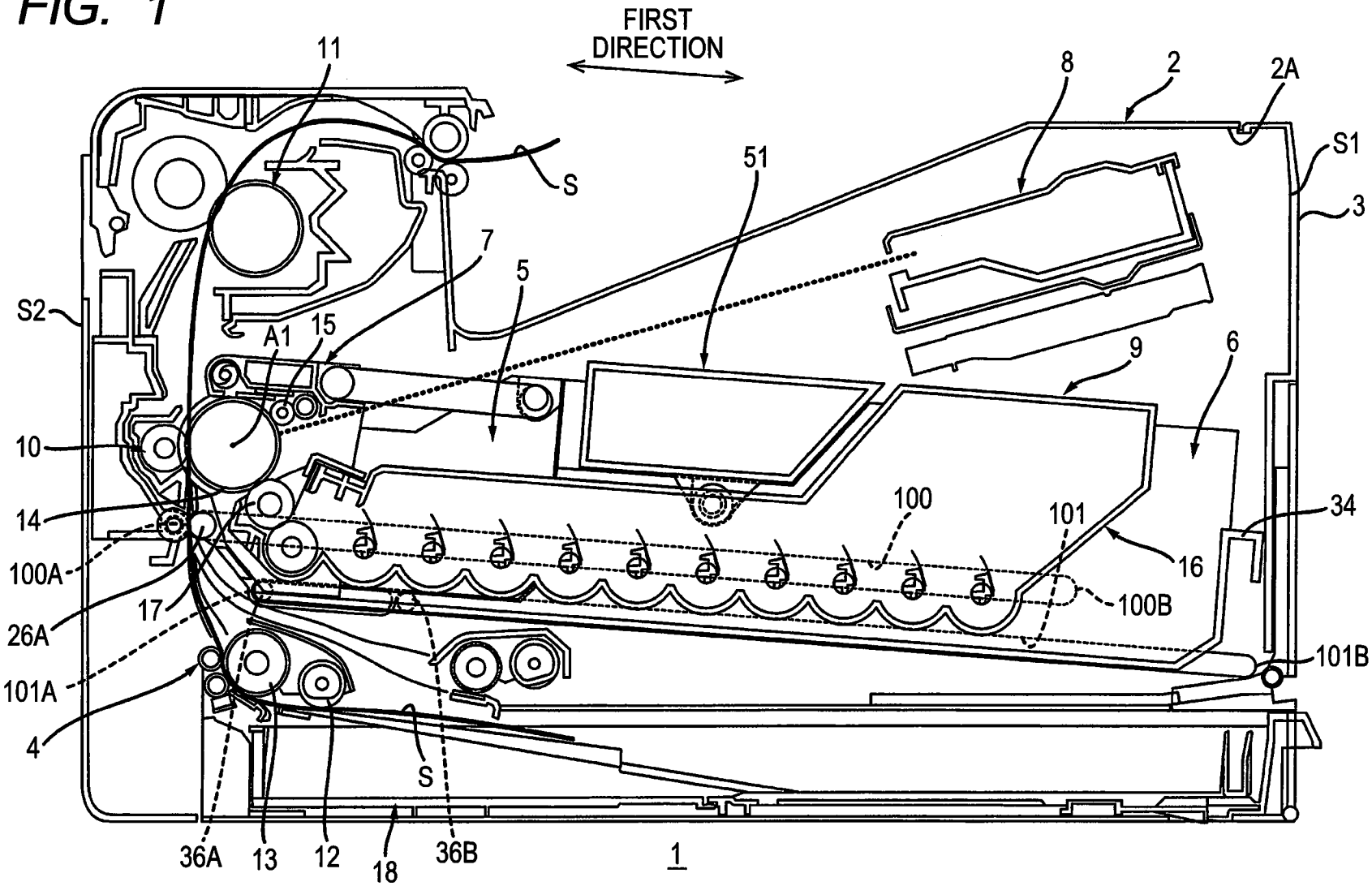
FIG. 1 is a schematic diagram showing an image forming apparatus.

As shown in FIG. 1, the image forming apparatus 1 includes a housing 2, a cover 3, a sheet feeder 4, a first cartridge support 5, a second cartridge support 6, a drum cartridge 7, an exposure device 8, a development cartridge 9, a transfer roller 10, and a fixing device 11. Here, the image forming apparatus 1 is dedicated to monochromatic printing. Thus, the image forming apparatus 1 includes one drum cartridge 7 and one development cartridge 9.

1.1 Housing 2 and Cover 3

The housing 2 accommodates the sheet feeder 4, the first cartridge support 5, the second cartridge support 6, the drum cartridge 7, the exposure device 8, the development cartridge 9, the transfer roller 10, and the fixing device 11. The housing 2 has an opening 2A. The housing 2 has a first outer surface S1 and a second outer surface S2. The opening 2A is provided at the first outer surface S1. The second outer surface S2 is located at an opposite side from the first outer surface S1 in the first direction.

The cover 3 is attached to the housing 2. The cover 3 is configured to move between a closed position (see FIG. 1) and an open position (see FIG. 2). In a state where the cover 3 is located at the closed position, the cover 3 closes the opening 2A. In a state where the cover 3 is located at the open position, the opening 2A is opened.

1.2 Sheet Feeder 4

The sheet feeder 4 includes a sheet feed cassette 18, a pickup roller 12, and a sheet feed roller 13. The sheet feed cassette 18 stores sheets S. The pickup roller 12 conveys a sheet S within the sheet feed cassette 18 toward the sheet feed roller 13. The sheet feed roller 13 conveys the sheet S from the pickup roller 12 toward the transfer roller 10.

1.3 First Cartridge Support 5

The first cartridge support 5 supports the drum cartridge 7. The first cartridge support 5 is configured to move in the first direction between a first position (see FIG. 1) and a second position (see FIG. 2). The first direction intersects a vertical direction. The first cartridge support 5 moves between the first position and the second position within the housing 2. That is, when the first cartridge support 5 moves from the first position to the second position, the first cartridge support 5 does not pass through the opening 2A. When the first cartridge support 5 is located at the first position, the drum cartridge 7 is mounted on the image forming apparatus 1. Here, the phrase "the drum cartridge 7 is mounted on the image forming apparatus 1" means that the drum cartridge 7 is accommodated within the housing 2 such that the drum cartridge 7 can operate. In this embodiment, in a state where the first cartridge support 5 supporting the drum cartridge 7 is located at the first position and hence a photosensitive drum 14 contacts the transfer roller 10, the drum cartridge 7 is mounted on the image forming apparatus 1. In a state where the first cartridge support 5 is located at the second position, the drum cartridge 7 can be detached from the first cartridge support 5. When the first cartridge support 5 moves from the first position to the second position, the first cartridge support 5 moves together with the second cartridge support 6.

1.4 Second Cartridge Support 6

The second cartridge support 6 supports the development cartridge 9. The second cartridge support 6 is configured to move in the first direction between a third position (see FIG. 1) and a fourth position (see FIG. 2). When the second cartridge support 6 moves from the third position to the fourth position, the second cartridge support 6 passes through the opening 2A. In a state where the second cartridge support 6 is located at the third position, an entirety of the second cartridge support 6 is located within the housing 2. In a state where the second cartridge support 6 is located at the third position, the development cartridge 9 is mounted on the drum cartridge 7. Here, the phrase "the development cartridge 9 is mounted on the drum cartridge 7" means that the development cartridge 9 is attached to the drum cartridge 7 such that the development cartridge 9 can supply toner to the drum cartridge 7. In this embodiment, in a state where the first cartridge support 5 supporting the drum cartridge 7 is located at the first position and the second cartridge support 6 supporting the development cartridge 9 is located at the third position and hence the photosensitive drum 14 contacts a development roller 17, the development cartridge 9 is mounted on the drum cartridge 7. In a state where the second cartridge support 6 is located at the third position, the second cartridge support 6 is located, in the first direction, between the first cartridge support 5 at the first position and the cover 3 at the closed position. In a state where the second cartridge support 6 is located at the third position, the second cartridge support 6 overlaps the first cartridge support 5 located at the first position as viewed from the first direction. Further, in a state where the second cartridge support 6 is located at the third position, the second cartridge support 6 overlaps the cover 3 located at the closed position as viewed from the first direction. In a state where the second cartridge support 6 is located at the fourth position, at least part of the second cartridge support 6 is located outside the housing 2. In a state where the second cartridge support 6 is located at the fourth position, the development cartridge 9 can be detached from the second cartridge support 6. Specifically, when the second cartridge support 6 moves from the third position toward the fourth position, the second cartridge support 6 is configured to move in a direction away from the first cartridge support 5, relative to the first cartridge support 5. Due to movement of the second cartridge support 6 in a direction away from the first cartridge support 5, the development cartridge 9 separates from the drum cartridge 7 and can be detached from the second cartridge support 6. More specifically, when the second cartridge support 6 moves from the third position to the fourth position, the second cartridge support 6 moves from the third position through a fifth position to the fourth position. The fifth position is a position at which the second cartridge support 6 is located between the third position and the fourth position in the first direction. When the second cartridge support 6 moves from the fifth position to the fourth position, the second cartridge support 6 is configured to move in a direction away from the first cartridge support 5 in the first direction. When the second cartridge support 6 moves from the fifth position to the fourth position, the second cartridge support 6 moves in a direction away from the first cartridge support 5 in the first direction, and hence the development cartridge 9 separates from the drum cartridge 7 and can be detached from the second cartridge support 6.

Figure 5:
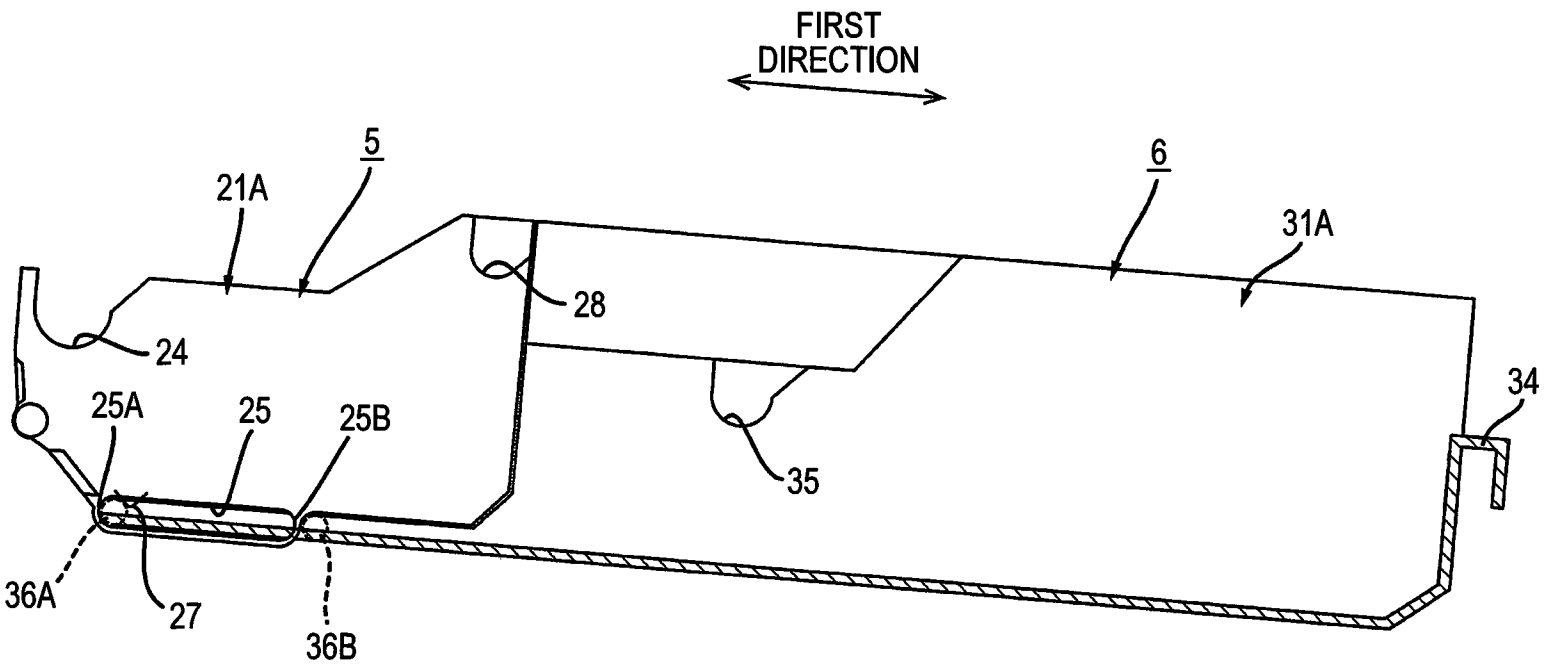
FIG. 5 shows a state where the first cartridge support shown in FIG. 4 is located at a first position and the second cartridge support is located at a third position.

More specifically, the second cartridge support 6 moves together with the first cartridge support 5 from the third position to the fifth position (as shown in FIG. 5, a spring 27 described later holds a second guided portion 36A described later). When the first cartridge support 5 cannot move farther at the second position (a first guided portion 26B described later contacts a second end 100B of a first main guide 100 described later), at that position (the fifth position), the second guided portion 36A overcomes the pressing force of the spring 27 and separates from the spring 27, and the second cartridge support 6 separates from the first cartridge support 5 and moves to the fourth position. In this way, the spring 27 of the first cartridge support 5 and the second guided portion 36A of the second cartridge support 6 function to hold the first cartridge support 5 and the second cartridge support 6 together such that the second cartridge support 6 moves together with the first cartridge support 5 from the third position to the fifth position.

1.5 Drum Cartridge 7

The drum cartridge 7 includes the photosensitive drum 14 and a charging roller 15.

The photosensitive drum 14 is configured to rotate about an axis A1 extending in the axial direction. The axial direction intersects both the first direction and the vertical direction. Preferably, the axial direction is perpendicular to both the first direction and the vertical direction. The photosensitive drum 14 extends in the axial direction. The photosensitive drum 14 has a cylindrical shape.

The charging roller 15 charges the circumferential surface of the photosensitive drum 14. The charging roller 15 contacts the circumferential surface of the photosensitive drum 14. Alternatively, the drum cartridge 7 may include a Scorotron charger instead of the charging roller 15.

1.6 Exposure Device 8

The exposure device 8 exposes the circumferential surface of the photosensitive drum 14 charged by the charging roller 15. Due to this operation, a latent image is formed on the circumferential surface of the photosensitive drum 14. Specifically, the exposure device 8 is a laser scan unit.

1.7 Development Cartridge 9

The development cartridge 9 includes a toner container 16.

The toner container 16 stores toner that is supplied to the photosensitive drum 14. The toner container 16 includes the development roller 17. That is, the development cartridge 9 includes the development roller 17.

In a state where the first cartridge support 5 supporting the drum cartridge 7 is located at the first position and the second cartridge support 6 supporting the development cartridge 9 is located at the third position, the development roller 17 contacts the photosensitive drum 14. In a state where the first cartridge support 5 supporting the drum cartridge 7 is located at the first position and the second cartridge support 6 supporting the development cartridge 9 is located at the third position, the development roller 17 is configured to supply toner within the toner container 16 to the photosensitive drum 14. Due to this configuration, the latent image formed on the photosensitive drum 14 is developed, and a toner image is formed on the circumferential surface of the photosensitive drum 14.

1.8 Transfer Roller 10

In a state where the drum cartridge 7 is mounted on the first cartridge support 5 and the first cartridge support 5 is located at the first position, the transfer roller 10 contacts the photosensitive drum 14. The sheet S fed from the sheet feed cassette 18 passes between the transfer roller 10 and the photosensitive drum 14. At this time, the transfer roller 10 transfers the toner image formed on the circumferential surface of the photosensitive drum 14 onto the sheet S.

1.9 Fixing Device 11

The fixing device 11 applies heat and pressure to the sheet S on which the toner image has been transferred, thereby fixing, onto the sheet S, the toner image transferred onto the sheet S from the photosensitive drum 14. The sheet S having passed the fixing device 11 is discharged onto the upper surface of the housing 2.

2. Details of First Cartridge Support 5 and Second Cartridge Support 6

Next, details of the first cartridge support 5 and the second cartridge support 6 will be described while referring to FIGS. 3 to 5.

2.1 First Cartridge Support 5

Figure 3:
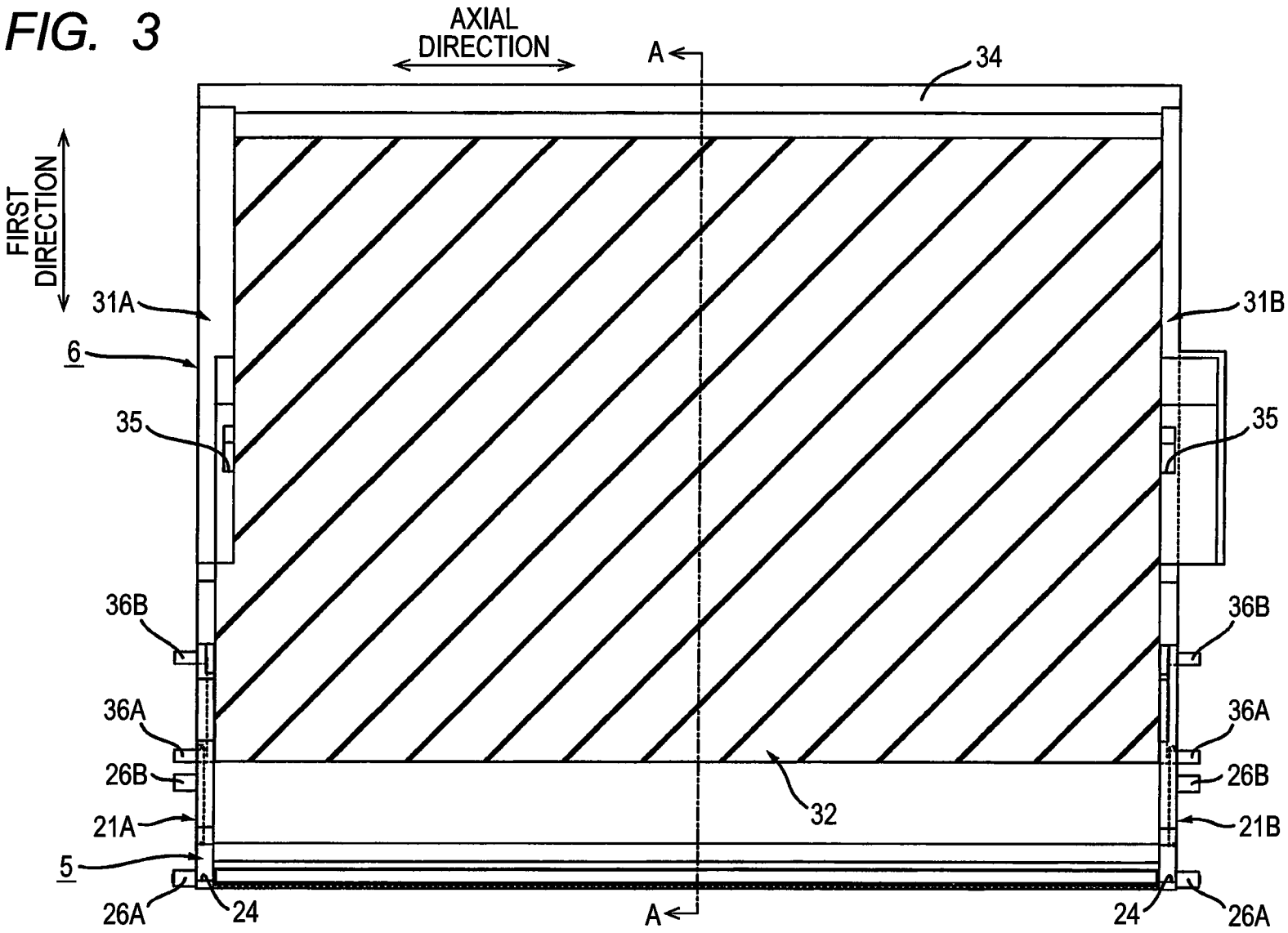
FIG. 3 is a plan view of the first cartridge support and the second cartridge support in a state where the first cartridge support is located at the second position and the second cartridge support is located at the fourth position.

As shown in FIG. 3, the first cartridge support 5 extends in the axial direction. The first cartridge support 5 includes two side plates 21A, 21B.

The side plate 21A is located at one end portion of the first cartridge support 5 in the axial direction. The side plate 21A extends in the first direction. As shown in FIG. 4, the side plate 21A has a cutout 24, a drawer guide 25, and a concave portion 28. That is, the first cartridge support 5 has the cutout 24 and the drawer guide 25.

In a state where the drum cartridge 7 is mounted on the first cartridge support 5, an end portion of the photosensitive drum 14 fits in the cutout 24. Specifically, in a state where the drum cartridge 7 is mounted on the first cartridge support 5, a drum coupling 42 (see FIG. 6) fits in the cutout 24. The drum coupling 42 will be described later.

The drawer guide 25 is located at a lower position than the cutout 24. The drawer guide 25 extends in the first direction. Specifically, the drawer guide 25 is a through hole. The drawer guide 25 has a seventh end 25A and an eighth end 25B. The eighth end 25B is located closer to the cover 3 at the closed position than the seventh end 25A is in the first direction. The second guided portion 36A of the second cartridge support 6 fits in the drawer guide 25. The second guided portion 36A will be described later. With this configuration, the drawer guide 25 guides movement of the second cartridge support 6 relative to the first cartridge support 5.

In a state where the drum cartridge 7 is mounted on the first cartridge support 5, a grip 45C (see FIG. 7A) of the drum cartridge 7 fits in the concave portion 28. The grip 45C will be described later. The concave portion 28 is located away from the cutout 24 in the first direction. Specifically, in a state where the first cartridge support 5 supporting the drum cartridge 7 is located at the first position, the concave portion 28 is located closer to the cover 3 at the closed position than the cutout 24 is in the first direction.

As shown in FIG. 3, the side plate 21A includes two first guided portions 26A, 26B and the spring 27. That is, the first cartridge support 5 includes the two first guided portions 26A, 26B and the spring 27 (see FIG. 4).

Figure 2:
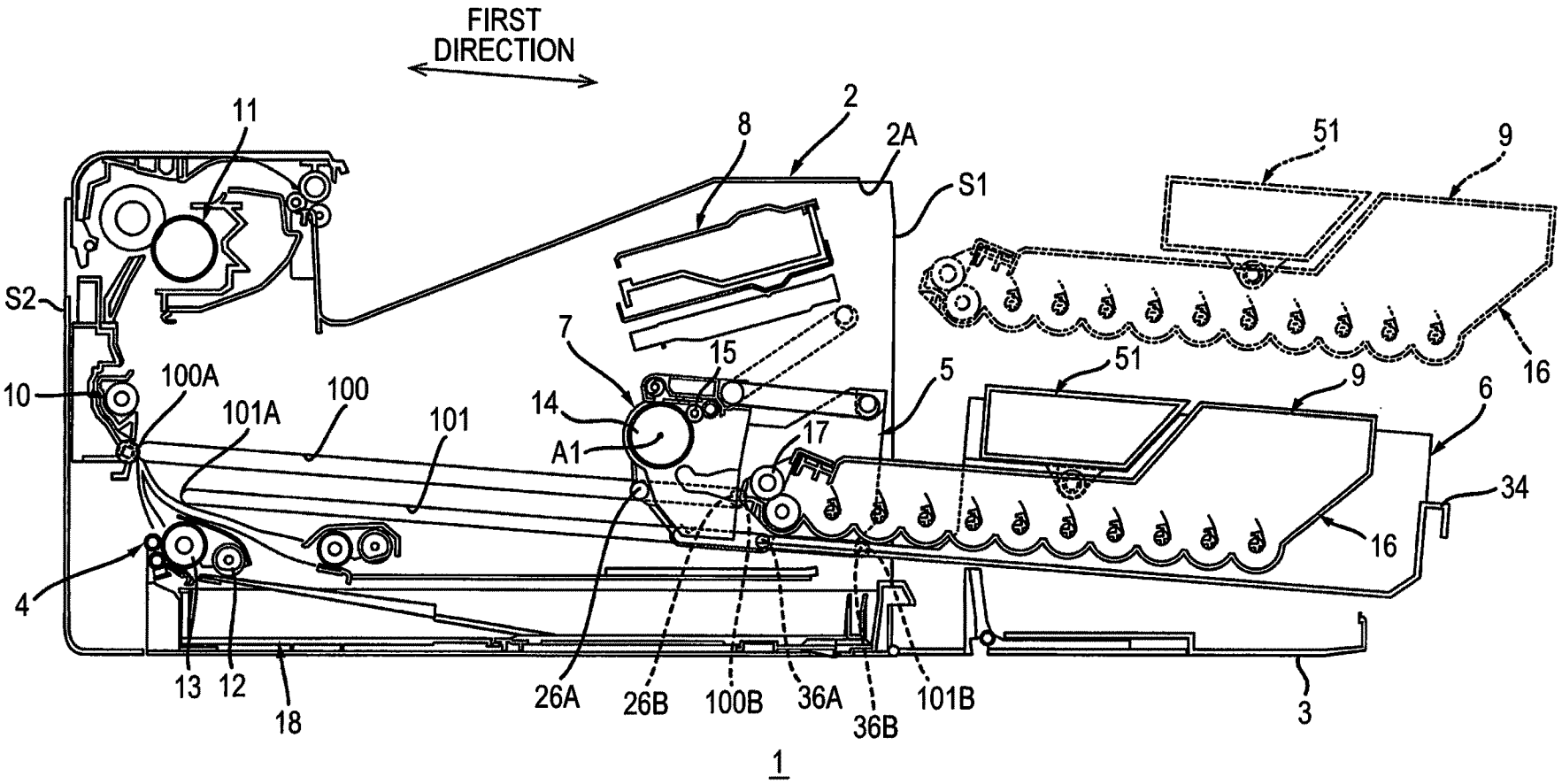
FIG. 2 shows a state where a first cartridge support shown in FIG. 1 is located at a second position and a second cartridge support is located at a fourth position.

The two first guided portions 26A, 26B are guided by the first main guide 100 (see FIG. 2). Specifically, as shown in FIG. 2, the image forming apparatus 1 includes the first main guide 100. The first main guide 100 is provided within the housing 2. The first main guide 100 extends in the first direction. The first main guide 100 has a first end 100A and the second end 100B in the first direction. The second end 100B is located closer to the cover 3 at the closed position than the first end 100A is in the first direction. In other words, the second end 100B is located between the first end 100A and the cover 3 at the closed position in the first direction. The two first guided portions 26A, 26B fit in the first main guide 100. With this configuration, the first main guide 100 guides the first cartridge support 5. As shown in FIG. 1, due to contact of the first guided portion 26A with the first end 100A of the first main guide 100, the first cartridge support 5 is located at the first position. As shown in FIG. 2, due to contact of the first guided portion 26B with the second end 100B of the first main guide 100, the first cartridge support 5 is located at the second position. That is, due to contact with the second end 100B of the first main guide 100, the first cartridge support 5 is located at the second position. In other words, the second end 100B of the first main guide 100 functions as a stopper for stopping the first cartridge support 5. As shown in FIG. 3, the two first guided portions 26A, 26B protrude in the axial direction. The two first guided portions 26A, 26B are bosses. The two first guided portions 26A, 26B have a columnar shape. The first main guide 100 (see FIG. 2) is a groove. The first main guide 100 is concave in the axial direction.

Figure 4:
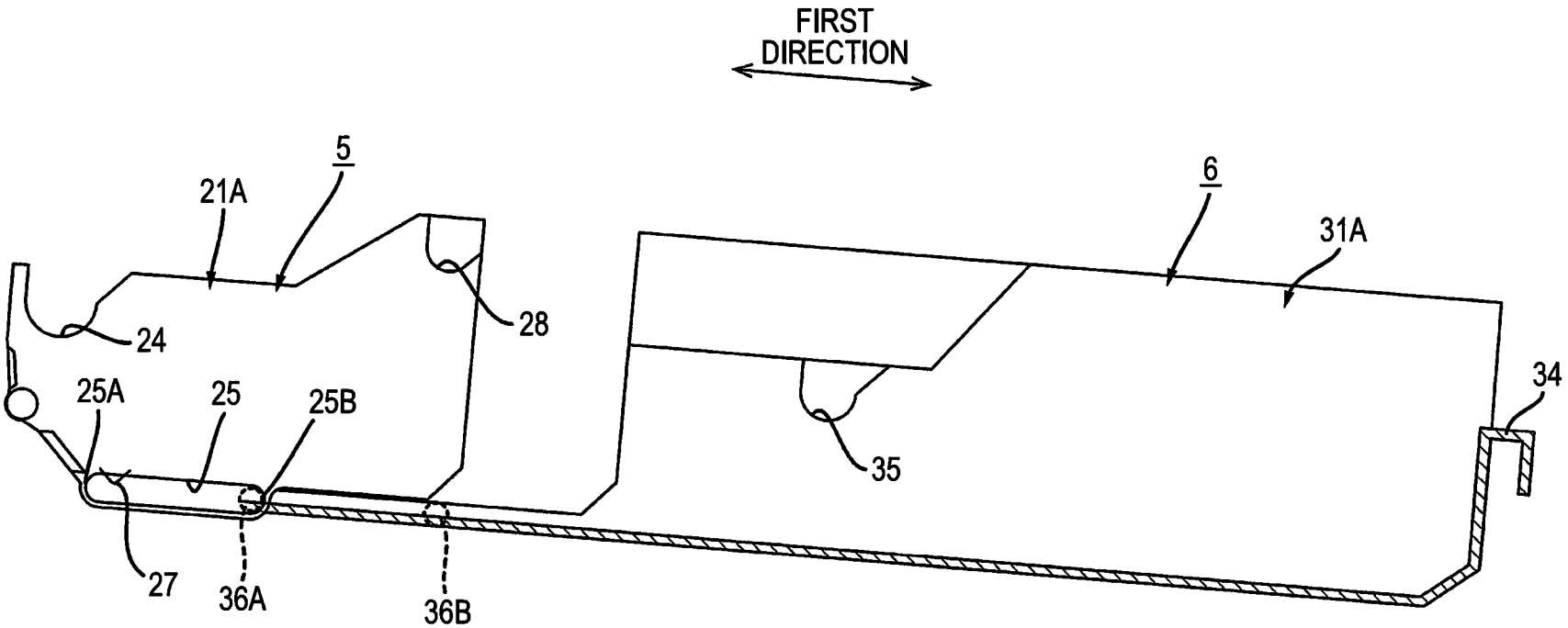
FIG. 4 is a cross-sectional view of the first cartridge support and the second cartridge support, taken along a line A-A in FIG. 3.

As shown in FIG. 4, the spring 27 protrudes to inside the drawer guide 25. Specifically, the spring 27 is a leaf spring. As shown in FIG. 5, in a state where the first cartridge support 5 is located at the first position and the second cartridge support 6 is located at the third position, the spring 27 presses a part of the second cartridge support 6 in a direction in which the second cartridge support 6 is urged from the fourth position toward the third position. Specifically, the part of the second cartridge support 6 is the second guided portion 36A.

As shown in FIG. 3, the side plate 21B is located at the other end portion of the first cartridge support 5 in the axial direction. The side plate 21B is located away from the side plate 21A in the axial direction. The side plate 21B extends in the first direction. As in the side plate 21A, the side plate 21B has a cutout 24 and a drawer guide 25, and includes two first guided portions 26A, 26B and a spring 27.

2.2 Second Cartridge Support 6

As shown in FIGS. 3 and 4, the second cartridge support 6 is coupled to the first cartridge support 5. As shown in FIGS. 4 and 5, the second cartridge support 6 is configured to move in the first direction relative to the first cartridge support 5. As shown in FIG. 3, the second cartridge support 6 extends in the axial direction. The second cartridge support 6 includes two side plates 31A, 31B, a bottom plate 32, and a grip 34.

The side plate 31A is located at one end portion of the second cartridge support 6 in the axial direction. The side plate 31A extends in the first direction. As shown in FIG. 4, the side plate 31A has a concave portion 35. That is, the second cartridge support 6 has the concave portion 35.

In a state where the development cartridge 9 is mounted on the second cartridge support 6, a shaft 52A (see FIG. 8) of the development cartridge 9 fits in the concave portion 35. With this configuration, in a state where the development cartridge 9 is supported by the second cartridge support 6, a waste-toner container 51 is fixed relative to the second cartridge support 6. The waste-toner container 51 will be described later.

As shown in FIG. 3, the side plate 31A includes two second guided portions 36A, 36B.

The two second guided portions 36A, 36B are guided by a second main guide 101 (see FIG. 2). Specifically, as shown in FIG. 2, the image forming apparatus 1 includes the second main guide 101. The second main guide 101 is provided within the housing 2. The second main guide 101 is located below the first main guide 100. The second main guide 101 extends in the first direction. The second main guide 101 has a third end 101A and a fourth end 101B in the first direction. The fourth end 101B is located closer to the cover 3 at the closed position than the third end 101A is in the first direction. The fourth end 101B is located between the third end 101A and the cover 3 at the closed position in the first direction. The fourth end 101B is located closer to the cover 3 at the closed position than the second end 100B of the first main guide 100 in the first direction. The two second guided portions 36A, 36B fit in the second main guide 101. With this configuration, the second main guide 101 guides the second cartridge support 6. As shown in FIG. 1, due to contact of the second guided portion 36A with the third end 101A of the second main guide 101, the second cartridge support 6 is located at the third position. As shown in FIG. 2, due to contact of the second guided portion 36B with the fourth end 101B of the second main guide 101, the second cartridge support 6 is located at the fourth position. That is, due to contact with the fourth end 101B of the second main guide 101, the second cartridge support 6 is located at the fourth position. As shown in FIG. 3, the two second guided portions 36A, 36B protrude in the axial direction. The two second guided portions 36A, 36B are bosses. The two second guided portions 36A, 36B have a columnar shape.

As shown in FIG. 4, the second guided portion 36A also fits in the drawer guide 25 of the first cartridge support 5. Hence, as shown in FIG. 5, in a state where the first cartridge support 5 is located at the first position, due to contact of the second guided portion 36A with the seventh end 25A of the drawer guide 25, the second cartridge support 6 may be located at the third position. Further, as shown in FIG. 4, in a state where the first cartridge support 5 is located at the second position, due to contact of the second guided portion 36A with the eighth end 25B of the drawer guide 25, the second cartridge support 6 may be located at the fourth position. That is, in a state where the first cartridge support 5 is located at the second position, due to contact with the eighth end 25B of the drawer guide 25, the second cartridge support 6 may be located at the fourth position.

As shown in FIG. 3, the side plate 31B is located at the other end portion of the second cartridge support 6 in the axial direction. The side plate 31B is located away from the side plate 31A in the axial direction. The side plate 31B extends in the first direction. As in the side plate 31A, the side plate 31B has a concave portion 35, and includes two second guided portions 36A, 36B.

As shown in FIG. 3, the bottom plate 32 is located between the side plate 31A and the side plate 31B in the axial direction. The bottom plate 32 extends in the axial direction. One end of the bottom plate 32 in the axial direction connects to the side plate 31A. The other end of the bottom plate 32 in the axial direction connects to the side plate 31B.

The grip 34 is gripped by a user for moving the second cartridge support 6. In a state where the development cartridge 9 is supported by the second cartridge support 6, the grip 34 is located at an opposite side from the photosensitive drum 14 with respect to at least part of the toner container 16.

3. Details of Drum Cartridge 7

Next, details of the drum cartridge 7 will be described while referring to FIGS. 6 to 7B.

Figure 6:
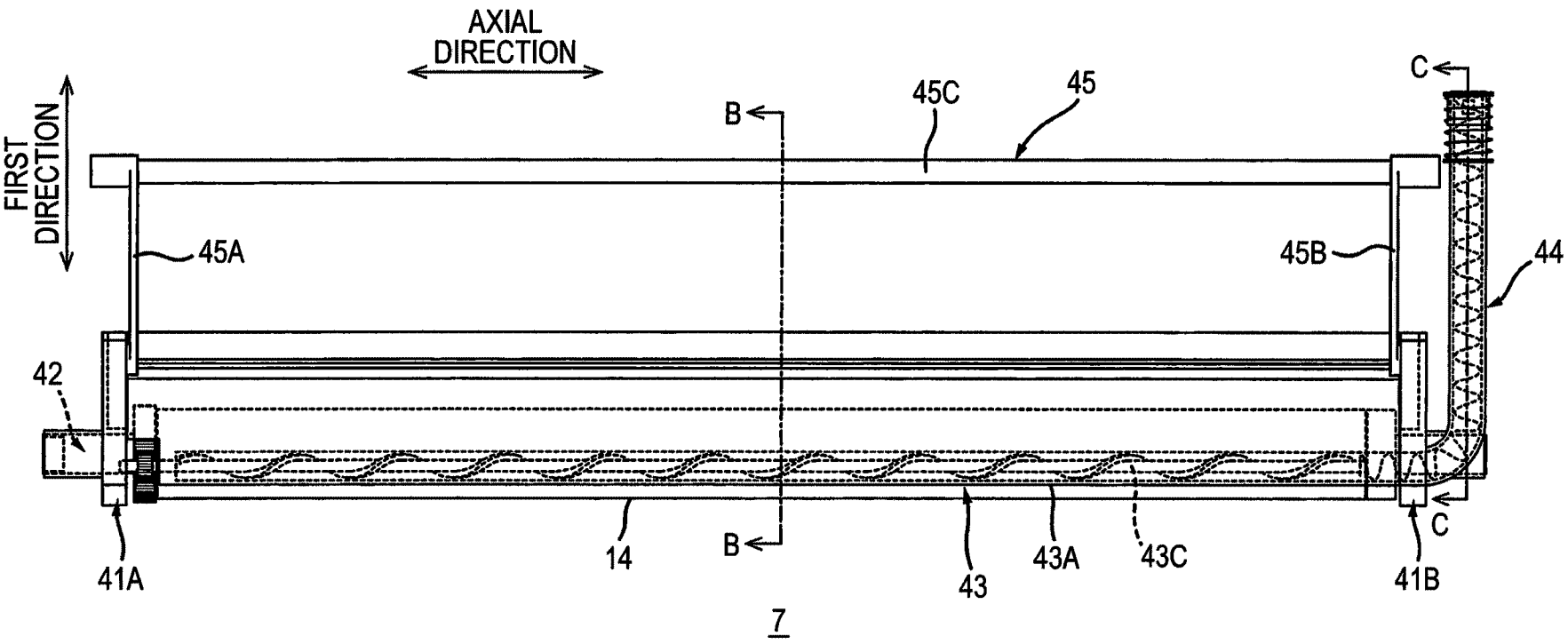
FIG. 6 is a plan view of a drum cartridge.

As shown in FIG. 6, the drum cartridge 7 extends in the axial direction. The drum cartridge 7 includes two side plates 41A, 41B, the drum coupling 42, a drum cleaner 43, a waste-toner conveyance pipe 44, and a handle 45 in addition to the photosensitive drum 14 and the charging roller 15 described above.

3.1 Side Plates 41A, 41B

Figure 7A:
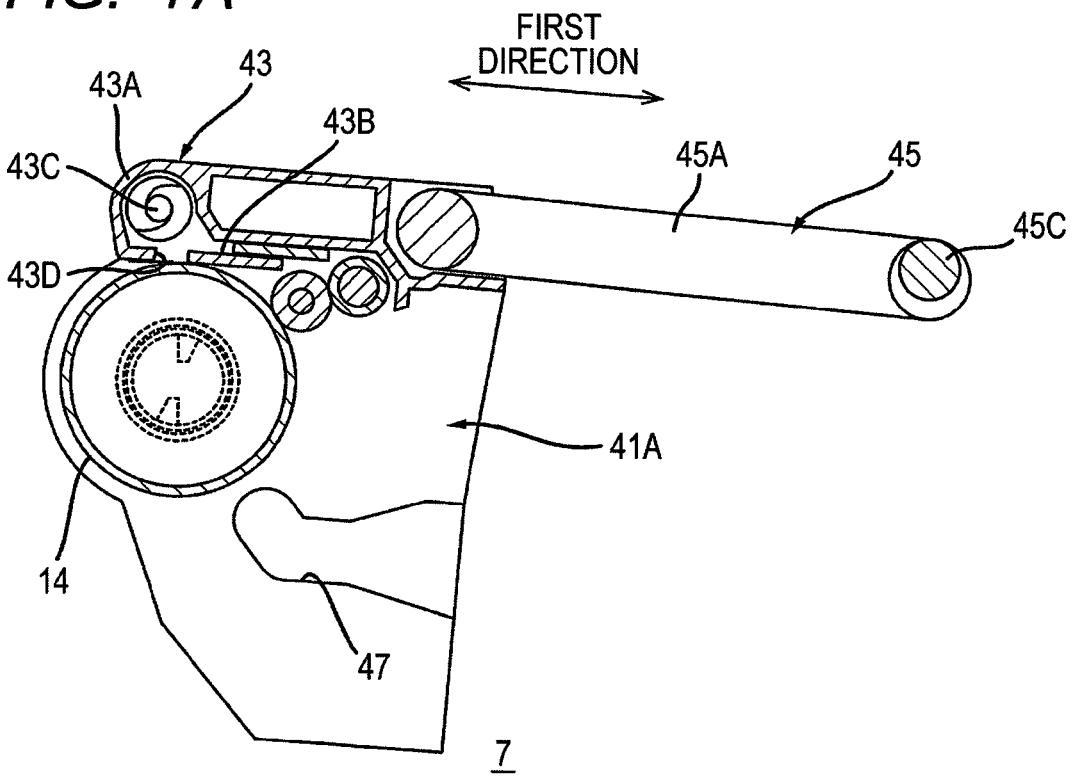
FIG. 7A is a cross-sectional view of the drum cartridge taken along a line B-B in FIG. 6.
Figure 7B:
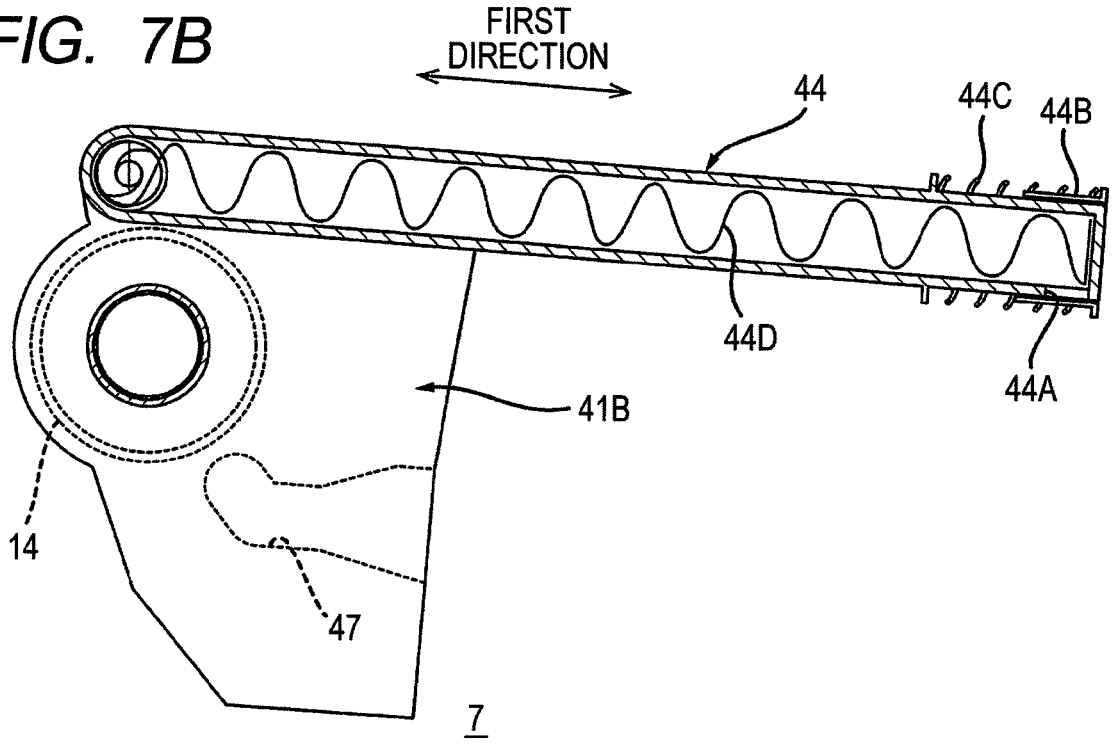
FIG. 7B is a cross-sectional view of the drum cartridge taken along a line C-C in FIG. 6.

As shown in FIG. 6, the side plate 41A is located at one end portion of the drum cartridge 7 in the axial direction. The side plate 41A extends in the first direction. As shown in FIG. 7A, the side plate 41A has a guide 47. That is, the drum cartridge 7 has the guide 47.

Figure 10:
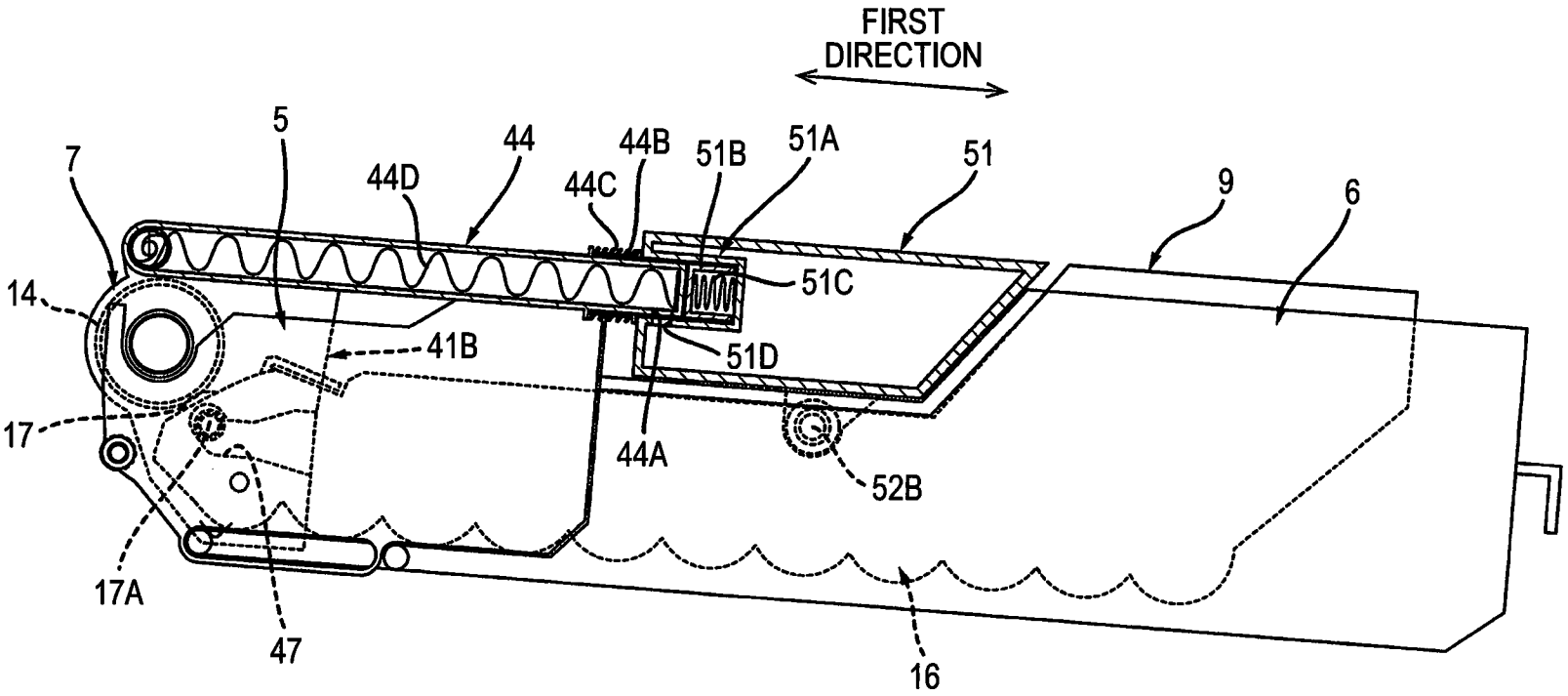
FIG. 10 shows a state where the first cartridge support supporting the drum cartridge is located at the first position and the second cartridge support supporting the development cartridge is located at the third position.
Figure 11:
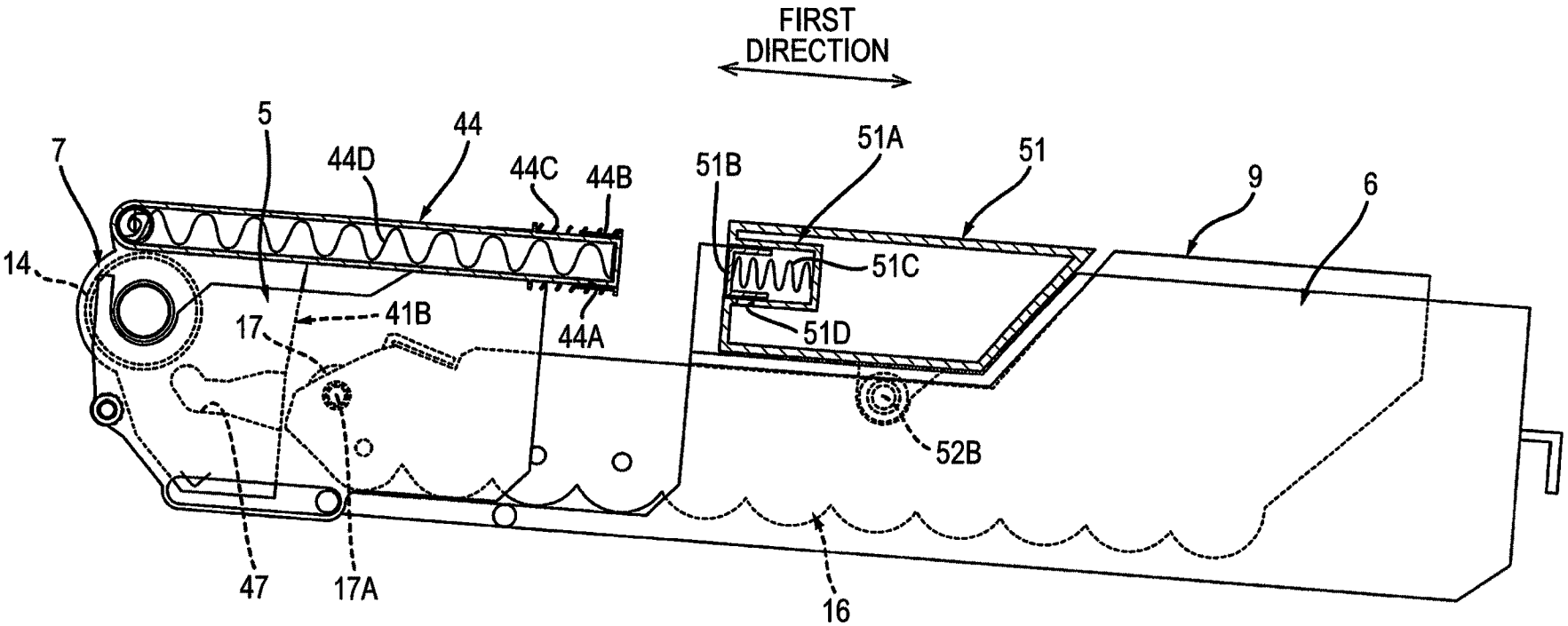
FIG. 11 shows a state where the first cartridge support supporting the drum cartridge is located at the second position and the second cartridge support supporting the development cartridge is located at the fourth position.

When the second cartridge support 6 supporting the development cartridge 9 moves closer to the first cartridge support 5 supporting the drum cartridge 7, the guide 47 guides the development roller 17 toward the photosensitive drum 14. The guide 47 extends toward the photosensitive drum 14. In this embodiment, the guide 47 extends in the first direction. Specifically, the guide 47 is a groove. As shown in FIG. 10, in a state where the first cartridge support 5 supporting the drum cartridge 7 is located at the first position and the second cartridge support 6 supporting the development cartridge 9 is located at the third position, an end portion of a shaft 17A of the development roller 17 fits in the guide 47. That is, by guiding the shaft 17A of the development roller 17, the guide 47 guides the development roller 17 toward the photosensitive drum 14. As shown in FIG. 11, in a state where the first cartridge support 5 supporting the drum cartridge 7 is located at the second position and the second cartridge support 6 supporting the development cartridge 9 is located at the fourth position, the shaft 17A of the development roller 17 separates from the guide 47.

As shown in FIG. 6, the side plate 41B is located at the other end portion of the drum cartridge 7 in the axial direction. The side plate 41B is located away from the side plate 41A in the axial direction. The side plate 41B extends in the first direction. As in the side plate 41A, the side plate 41B has a guide 47.

3.2 Drum Coupling 42

As shown in FIG. 6, the drum coupling 42 is attached to one end portion of the photosensitive drum 14 in the axial direction. The drum coupling 42 is configured to rotate together with the photosensitive drum 14. The drum coupling 42 is rotatably supported by the side plate 41A. In a state where the drum cartridge 7 is mounted on the first cartridge support 5, the drum coupling 42 fits in the cutout 24 (see FIG. 4). In a state where the drum cartridge 7 is mounted on the first cartridge support 5 and the first cartridge support 5 is located at the first position, a main coupling (not shown) provided in the housing 2 fits in the drum coupling 42. In a state where the main coupling fits in the drum coupling 42, the drum coupling 42 is configured to rotate together with the main coupling. With this configuration, the drum coupling 42 receives power from the main coupling and causes the photosensitive drum 14 to rotate.

3.3 Drum Cleaner 43

As shown in FIG. 7A, the drum cleaner 43 is located above the photosensitive drum 14 in a state where the drum cartridge 7 is mounted on the first cartridge support 5. The drum cleaner 43 includes a cleaner frame 43A, a cleaning member 43B, and an auger screw 43C.

As shown in FIG. 6, the cleaner frame 43A is located between the side plate 41A and the side plate 41B in the axial direction. The cleaner frame 43A extends in the axial direction. One end of the cleaner frame 43A in the axial direction connects to the side plate 41A. The other end of the cleaner frame 43A in the axial direction connects to the side plate 41B. As shown in FIG. 7A, the cleaner frame 43A has an opening 43D. The opening 43D communicates with the internal space of the cleaner frame 43A.

The cleaning member 43B is attached to the cleaner frame 43A. The cleaning member 43B extends in the axial direction, and has a plate shape. An edge of the cleaning member 43B is located within the opening 43D. The edge of the cleaning member 43B contacts the circumferential surface of the photosensitive drum 14. With this configuration, when the photosensitive drum 14 rotates, toner adhering to the circumferential surface of the photosensitive drum 14 is scraped off by the edge of the cleaning member 43B, and moves into the inside of the cleaner frame 43A through the opening 43D. With this configuration, the drum cleaner 43 cleans the circumferential surface of the photosensitive drum 14. The toner removed from the circumferential surface of the photosensitive drum 14 by the drum cleaner 43 is referred to as "waste toner".

As shown in FIG. 6, the auger screw 43C is located within the cleaner frame 43A. The auger screw 43C extends in the axial direction. The auger screw 43C conveys waste toner stored in the cleaner frame 43A toward the waste-toner conveyance pipe 44.

3.4 Waste-Toner Conveyance Pipe 44

As shown in FIG. 6, the waste-toner conveyance pipe 44 is attached to the side plate 41B. The waste-toner conveyance pipe 44 is used for conveying waste toner from the drum cleaner 43 to the waste-toner container 51 (see FIG. 1). The internal space of the waste-toner conveyance pipe 44 communicates with the internal space of the cleaner frame 43A. As shown in FIG. 7B, the waste-toner conveyance pipe 44 has a discharge port 44A. The waste-toner conveyance pipe 44 includes a shutter 44B, a spring 44C, and a shaftless screw 44D.

The discharge port 44A is located at an end portion of the waste-toner conveyance pipe 44. The discharge port 44A communicates with the internal space of the waste-toner conveyance pipe 44. The discharge port 44A is configured to discharge waste toner within the waste-toner conveyance pipe 44.

The shutter 44B is located at an end portion of the waste-toner conveyance pipe 44. The shutter 44B is configured to move between the closed position (see FIG. 7B) and the open position (see FIG. 10). In a case where the shutter 44B is located at the closed position, the shutter 44B closes the discharge port 44A. In a case where the shutter 44B is located at the open position, the discharge port 44A is opened.

The spring 44C is located at the outer circumferential surface of the waste-toner conveyance pipe 44. The spring 44C presses the shutter 44B located at the open position toward the closed position.

The shaftless screw 44D is located within the waste-toner conveyance pipe 44. The shaftless screw 44D extends along the waste-toner conveyance pipe 44. The shaftless screw 44D is coupled to the auger screw 43C and rotates together with the auger screw 43C, thereby conveys toner within the waste-toner conveyance pipe 44 toward the discharge port 44A.

3.5 Handle 45

As shown in FIG. 6, the handle 45 is located between the side plate 41A and the side plate 41B in the axial direction. As shown in FIG. 7A, the handle 45 is located at an upper position relative to the guide 47. As shown in FIG. 6, the handle 45 includes two arms 45A, 45B and the grip 45C.

The arm 45A extends in the first direction. The arm 45A is rotatably attached to the side plate 41A.

The arm 45B is located away from the arm 45A in the axial direction. The arm 45B extends in the first direction. The arm 45B is rotatably attached to the side plate 41B. The arm 45A is rotatably attached to the side plate 41A, the arm 45B is rotatably attached to the side plate 41B, and thereby the handle 45 is rotatably supported by the side plate 41A and the side plate 41B.

The grip 45C is located between the arm 45A and the arm 45B in the axial direction. The grip 45C extends in the axial direction. The grip 45C has a columnar shape. One end portion of the grip 45C in the axial direction is supported by the arm 45A. The other end portion of the grip 45C in the axial direction is supported by the arm 45B.

4. Details of Development Cartridge 9

Next, details of the development cartridge 9 will be described while referring to FIGS. 8 to 11.

Figure 8:
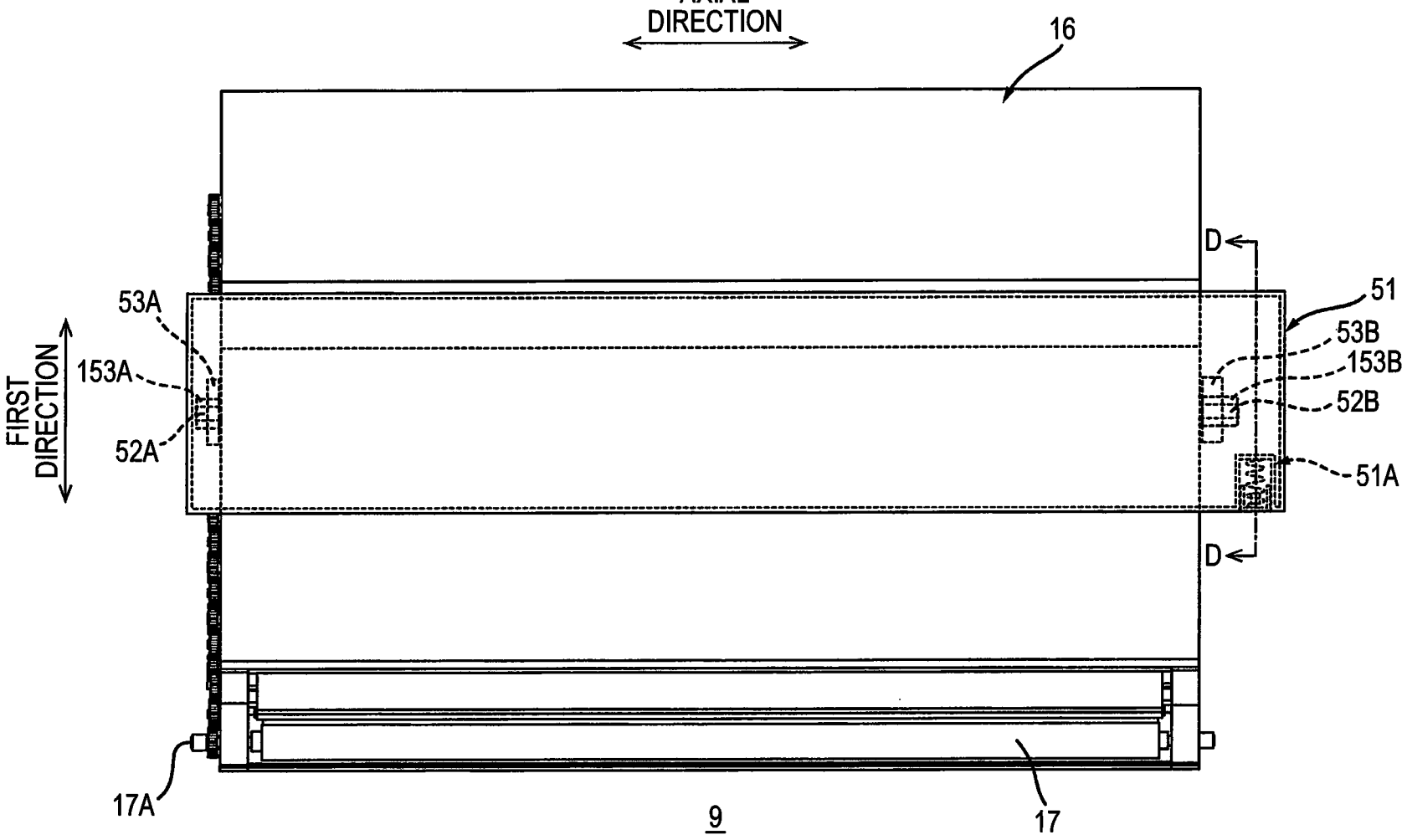
FIG. 8 is a plan view of a development cartridge.
Figure 9:
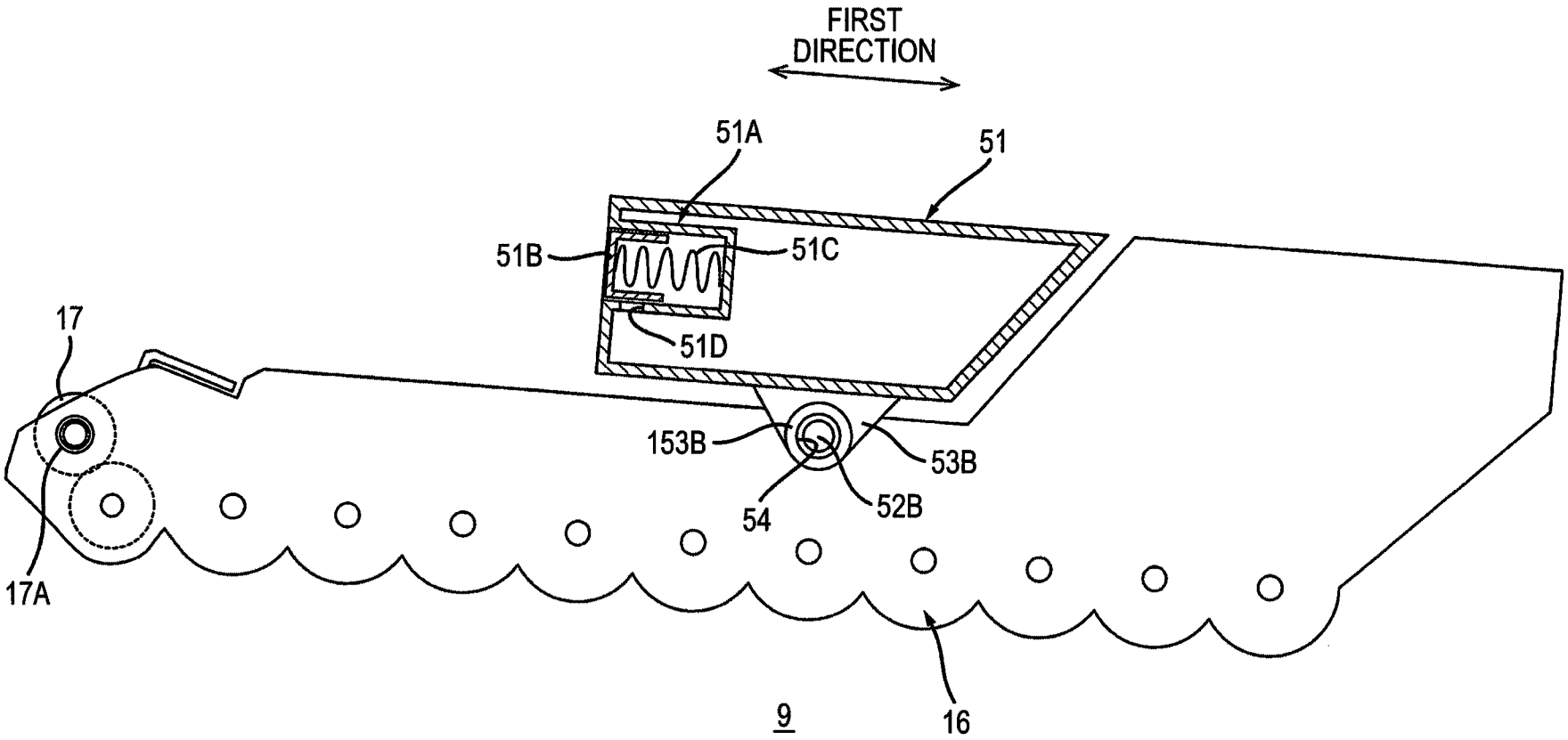
FIG. 9 is a cross-sectional view of the drum cartridge taken along a line D-D in FIG. 8.

As shown in FIGS. 8 and 9, the development cartridge 9 includes the waste-toner container 51 and two shafts 52A, 52B in addition to the toner container 16.

4.1 Waste-Toner Container 51

As shown in FIG. 8, the waste-toner container 51 extends in the axial direction. The waste-toner container 51 has a box shape. The waste-toner container 51 stores waste toner. As shown in FIG. 9, the waste-toner container 51 is attached to an upper part of the toner container 16. The waste-toner container 51 is swingably attached to the toner container 16. The waste-toner container 51 includes an insertion portion 51A, a shutter 51B, a spring 51C, and two protrusions 53A, 53B (see FIG. 8). As shown in FIG. 9, the protrusion 53B has a triangular plate shape. A cylindrical portion 153B extending in the axial direction is provided at the lower end of the protrusion 53B. A through hole 54 extending in the axial direction is formed through the cylindrical portion 153B. The protrusion 53A has a similar configuration to that of the protrusion 53B. As shown in FIG. 8, a cylindrical portion 153A formed with a through hole (not shown) is provided at the lower end of the protrusion 53A.

As shown in FIG. 10, in a state where the first cartridge support 5 supporting the drum cartridge 7 is located at the first position and the second cartridge support 6 supporting the development cartridge 9 is located at the third position, the waste-toner conveyance pipe 44 (see FIG. 6) of the drum cartridge 7 is inserted in the insertion portion 51A. That is, in a state where the first cartridge support 5 supporting the drum cartridge 7 is located at the first position and the second cartridge support 6 supporting the development cartridge 9 is located at the third position, the waste-toner conveyance pipe 44 is connected to the waste-toner container 51. On the other hand, as shown in FIG. 11, in a state where the first cartridge support 5 supporting the drum cartridge 7 is located at the second position and the second cartridge support 6 supporting the development cartridge 9 is located at the fourth position, the waste-toner conveyance pipe 44 separates from the insertion portion 51A. That is, in a state where the first cartridge support 5 supporting the drum cartridge 7 is located at the second position and the second cartridge support 6 supporting the development cartridge 9 is located at the fourth position, connection between the waste-toner conveyance pipe 44 and the waste-toner container 51 is stopped.

As shown in FIG. 9, the insertion portion 51A is located within the waste-toner container 51. The insertion portion 51A extends in the first direction. The insertion portion 51A has a tubular shape (cylindrical shape). The insertion portion 51A has a reception port 51D. The reception port 51D communicates with the internal space of the waste-toner container 51. In a state where the waste-toner conveyance pipe 44 is connected to the insertion portion 51A (see FIG. 10), the reception port 51D communicates with the discharge port 44A of the waste-toner conveyance pipe 44. With this configuration, in a state where the waste-toner conveyance pipe 44 is connected to the insertion portion 51A, waste toner conveyed through the waste-toner conveyance pipe 44 passes through the discharge port 44A and the reception port 51D and moves into the inside of the waste-toner container 51.

The shutter 51B is located within the insertion portion 51A. The shutter 51B is configured to move between the closed position (see FIG. 9) and the open position (see FIG. 10). In a state where the shutter 51B is located at the closed position, the shutter 51B closes the reception port 51D. In a state where the shutter 51B is located at the open position, the reception port 51D is opened.

The spring 51C is located within the insertion portion 51A. The spring 51C presses the shutter 51B located at the open position toward the closed position.

As shown in FIGS. 8 and 9, each of the two protrusions 53A, 53B protrudes from the lower surface of the waste-toner container 51. Each of the two protrusions 53A, 53B extends in the vertical direction. The protrusion 53B is located away from the protrusion 53A in the axial direction. The toner container 16 is located between the protrusion 53A and the protrusion 53B in the axial direction. Each of the two protrusions 53A, 53B has the through hole 54 (see FIG. 9) described above. The through hole 54 has a circular shape.

4.2 Shaft 52A, 52B

As shown in FIG. 8, the shaft 52A extends from a side surface at one side of the toner container 16 in the axial direction. The shaft 52A extends in the axial direction. The shaft 52A has a columnar shape. The shaft 52A is inserted in the through hole 54 of the protrusion 53A (specifically, the cylindrical portion 153A) of the waste-toner container 51.

The shaft 52B extends from a side surface at the other side of the toner container 16 in the axial direction. The shaft 52B is inserted in the through hole 54 of the protrusion 53B (specifically, the cylindrical portion 153B) of the waste-toner container 51. The shaft 52A is inserted in the through hole 54 of the protrusion 53A of the waste-toner container 51, and the shaft 52B is inserted in the through hole 54 of the protrusion 53B of the waste-toner container 51, thereby the waste-toner container 51 is swingably attached to the toner container 16. That is, the shafts 52A, 52B couple the waste-toner container 51 with the toner container 16 such that the waste-toner container 51 swingably moves relative to the toner container 16.

5. Replacement Operation of Development Cartridge 9 and Drum Cartridge 7

Next, the replacement operation of the development cartridge 9 and the drum cartridge 7 will be described while referring to FIGS. 1, 2, and 11.

As shown in FIGS. 1 and 2, when a user replaces the development cartridge 9 and the drum cartridge 7, in a state where the cover 3 is located at the open position, the user pulls the grip 34 of the second cartridge support 6 so as to pull the second cartridge support 6 out of the housing 2.

Then, the second cartridge support 6 moves from the third position to the fourth position. At this time, the first cartridge support 5 is pulled by the second cartridge support 6, and moves from the first position to the second position. The second cartridge support 6 moves in a direction away from the first cartridge support 5 in the first direction relative to the first cartridge support 5, from the fifth position to the fourth position described above.

As shown in FIG. 11, when the second cartridge support 6 moves in a direction away from the first cartridge support 5, the development cartridge 9 supported by the second cartridge support 6 separates from the drum cartridge 7 supported by the first cartridge support 5. Specifically, when the second cartridge support 6 separates from the first cartridge support 5, the shaft 17A of the development roller 17 separates from the guide 47, and the waste-toner conveyance pipe 44 separates from the waste-toner container 51. In this state, the development cartridge 9 can be detached from the second cartridge support 6. That is, when the second cartridge support 6 moves in a direction away from the first cartridge support 5, the development roller 17 separates from the guide 47, the waste-toner conveyance pipe 44 separates from the waste-toner container 51, and the development cartridge 9 can be detached from the second cartridge support 6.

Next, as indicated by the imaginary lines (the double-dot chain lines) in FIG. 2, the user detaches the development cartridge 9 from the second cartridge support 6.

Thus, the user can replace the development cartridge 9 without replacing the drum cartridge 7.

Further, after detaching the development cartridge 9 from the second cartridge support 6, the user can also detach the drum cartridge 7 from the first cartridge support 5.

Thus, the user can also replace both the drum cartridge 7 and the development cartridge 9.

6. Operations and Effects (1) According to the image forming apparatus 1, as shown in FIGS. 1 and 2, due to movement of the second cartridge support 6 from the third position toward the fourth position, it becomes a state in which the development cartridge 9 can be detached.

With this configuration, the user can separate the development cartridge 9 from the drum cartridge 7 to replace the development cartridge 9, with a simple operation of moving the second cartridge support 6 from the third position to the fourth position.

(2) According to the image forming apparatus 1, as shown in FIG. 1, the development cartridge 9 includes the waste-toner container 51. As shown in FIG. 10, in a state where the first cartridge support 5 supporting the drum cartridge 7 is located at the first position and the second cartridge support 6 supporting the development cartridge 9 is located at the third position, the waste-toner conveyance pipe 44 of the drum cartridge 7 is connected to the waste-toner container 51.

With this configuration, waste toner removed from the circumferential surface of the photosensitive drum 14 by the drum cleaner 43 can be stored into the waste-toner container 51 by the waste-toner conveyance pipe 44.

As shown in FIG. 2, the waste-toner container 51 storing waste toner can be replaced together with the development cartridge 9.

7. Modification

While the disclosure has been described in detail with reference to the above aspects thereof, it would be apparent to those skilled in the art that various changes and modifications may be made therein without departing from the scope of the claims. An example is provided below.

A modification will be described while referring to FIG. 12.

Figure 12:
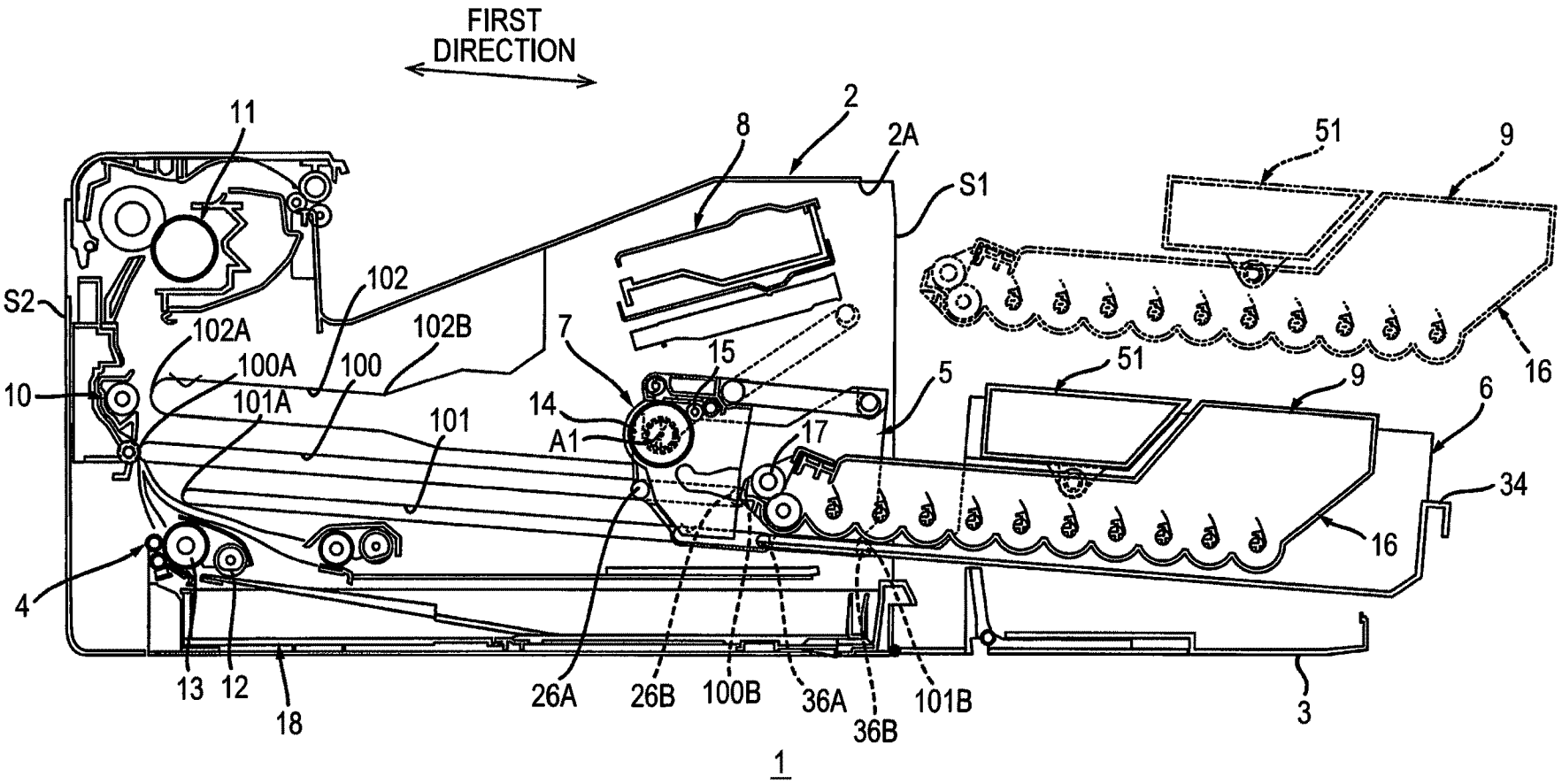
FIG. 12 is an explanatory diagram for illustrating a modification.

As shown in FIG. 12, the image forming apparatus 1 may further include a third main guide 102.

The third main guide 102 has a fifth end 102A and a sixth end 102B. The sixth end 102B is located closer to the cover 3 at the closed position than the fifth end 102A is in the first direction. The first end 100A of the first main guide 100 is farther away from the cover 3 at the closed position than the fifth end 102A of the third main guide 102 is. In other words, the first end 100A of the first main guide 100 is farther separated from the cover 3 at the closed position than the fifth end 102A of the third main guide 102 is. Specifically, the third main guide 102 is a groove. An end portion of the photosensitive drum 14 in the axial direction fits in the third main guide 102. With this configuration, the third main guide 102 guides the photosensitive drum 14.

What is claimed is:

1. An image forming apparatus comprising:

a housing;

a fixing device configured to fix a toner image on a sheet a drum cartridge comprising:

a photosensitive drum disposed below the fixing device; and a drum cleaner configured to remove toner from a circumferential surface of the photosensitive drum, the drum cleaner including a cleaning member contacting an upper part of the circumferential surface of the photosensitive drum; and a pipe configured to convey waste toner from the drum cleaner, the pipe having a discharge port and a discharge shutter, the discharge shutter movable between an open position where the discharge port is open and a closed position where the discharge port is closed;

an exposure device configured to expose the photosensitive drum; and a development cartridge disposed below the exposure device, the development cartridge comprising:

a development roller;

a toner container configured to store toner supplied to the photosensitive drum; and a waste-toner container configured to store waste toner conveyed by the pipe, the waste-toner container attached to the toner container such that the waste-toner container swingably moves relative to the toner container, the waste-toner container having a reception port and a reception shutter, the reception shutter movable between an open position where the reception port is open and a closed position where the reception port is closed, wherein the fixing device, the drum cleaner, and the photosensitive drum are arranged in this order in a vertical direction; and wherein the exposure device is located at a higher position than the waste-toner container, and the waste-toner container is located at a higher position than the toner container.

2. The image forming apparatus according to claim 1, wherein the toner container supports the development roller; and wherein the toner container is movable relative to the drum cartridge and the waste-toner container in a state where the drum cartridge and the development cartridge are attached to the housing.

3. The image forming apparatus according to claim 1, wherein the toner container is disposed below the waste-toner container.

4. The image forming apparatus according to claim 1, wherein the development roller is disposed below the pipe.

5. The image forming apparatus according to claim 1, wherein the housing includes a first outer surface and a second outer surface spaced from the first outer surface in a direction, the first outer surface having an opening.

6. The image forming apparatus according to claim 5, further comprising a cartridge support configured to support the drum cartridge and the development cartridge, wherein the cartridge support is movable between a first position and a second position through the opening.

7. The image forming apparatus according to claim 5, wherein the housing includes a sheet feed roller; and wherein the sheet feed roller is nearer from the second outer surface than from the first outer surface.

8. The image forming apparatus according to claim 1, wherein the drum cleaner has a plate shape.

9. The image forming apparatus according to claim 1, wherein the drum cartridge includes a side plate supporting the photosensitive drum; and wherein the pipe is located at an opposite side of the photosensitive drum with respect to the side plate.

10. The image forming apparatus according to claim 1, wherein the pipe includes a screw configured to convey toner from the drum cleaner to the waste-toner container.

* * * * *